United States Patent [19]

Larson

[11] 4,007,518

[45] Feb. 15, 1977

[54] STEAM SUPPLY APPARATUS

[75] Inventor: Harold A. Larson, Greenville, S.C.

[73] Assignee: Phillips Petroleum Company, Bartlesville, Okla.

[22] Filed: Aug. 25, 1975

[21] Appl. No.: 607,328

[52] U.S. Cl. ..... 28/1.6; 34/72; 122/483

[51] Int. Cl.[2] ..... D02G 1/12

[58] Field of Search ..... 34/72, 73, 46, 51; 122/32, 483; 165/39; 28/1.4, 1.6, 74.14, 74.12

[56] References Cited

UNITED STATES PATENTS

| | | | |
|---|---|---|---|
| 3,117,620 | 1/1964 | Fuller, Jr. | 122/406 B |
| 3,140,824 | 7/1964 | Moore | 165/39 |
| 3,574,303 | 4/1971 | Rabas | 122/483 |
| 3,693,222 | 9/1972 | Caffry | 28/1.6 |
| 3,758,960 | 9/1973 | McCreary | 34/46 |

*Primary Examiner*—Kenneth W. Sprague
*Assistant Examiner*—James C. Yeung

[57] ABSTRACT

Steam which is free of condensate is supplied to a fluid jet yarn texturing device. The steam is obtained by passing saturated steam through a condensate separator and then through a superheater. The amount of heat supplied by the superheater is regulated in response to a measurement of the temperature of the steam introduced into the texturing device.

6 Claims, 1 Drawing Figure

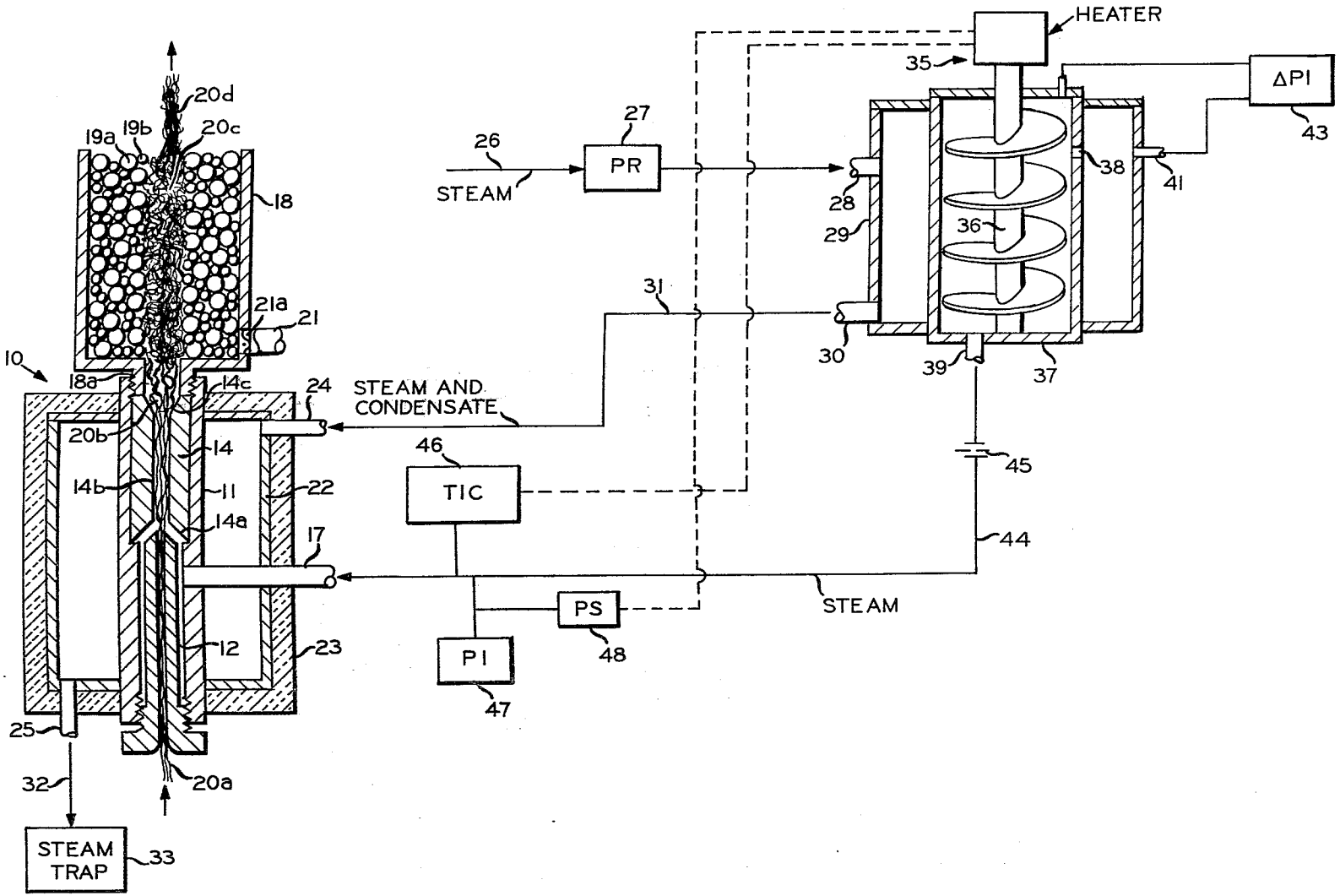
ΔPI
43
41
HEATER
38
37
35
36
39
45
44
28
29
30
STEAM
27
PR
31
PS
48
26
STEAM
STEAM AND CONDENSATE
TIC
46
PI
47
24
22
17
23
18
21
21a
14c
14
11
14a
12
20a
20d
20c
19b
19a
18a
20b
14b
33
STEAM TRAP
10
25
32

STEAM SUPPLY APPARATUS

Synthetic fibers are commonly produced by extruding molten polymer through a spinneret. In order to produce yarns which have properties approximating those of wool or other natural materials, it is customary to subject the extruded fibers to a texturing process. This can be accomplished by a variety of procedures well known in the art, such as stuffer-box crimping, false twisting, and fluid jet texturing. One particularly effective procedure involves contacting the fibers with a high velocity fluid stream in a turbulent zone. The turbulence imparted to the fibers produces crimps which give the fibers a textured appearance. Steam is usually employed as the fluid in such a process in order to provide an elevated temperature required to texture the yarn. It has been found that processes of this type produce more uniform yarn when the steam is provided at constant conditions of temperature, pressure and flow and wherin the steam is free of condensate.

In accordance with this invention, apparatus is provided which is capable of supplying steam to a jet texturing device at a constant temperature, pressure and flow rate and under conditions such that the steam is free of condensate. This is accomplished by introducing a stream of saturated steam into a separation device to remove condensate. The resulting steam is then passed through a superheater before being supplied to a yarn texturing device. The steam is passed through the separator and heater at a constant flow rate which can be monitored by a measuring device. The amount of heat supplied by the superheater is regulated in response to a measurement of the temperature of the steam introduced into the texturing device. A portion of the steam introduced into the separator and any resulting condensate can be passed through a jacket which surrounds the texturing device so as to impart additional heat to the device.

The accompanying drawing is a schematic representation of an embodiment of the apparatus of this invention.

Referring now to the drawing in detail, there is shown a fluid jet texturing device generally designated by reference numeral 10. This device comprises an elongated sleeve 11 which has a hollow needle 12 positioned in the inlet section thereof. Needle 12 can be threaded to sleeve 11 so that the position of the needle within the sleeve can be adjusted. An elongated plug 14 is disposed within the outlet section of sleeve 11. Plug 14 has a central opening **14*b* therethrough. The inlet opening of plug 14 is tapered to provide a seat 14*a* adjacent the tip of needle 12. The outlet of opening 14*b* constitutes a flared section 14*c*. A conduit 16 communicates with sleeve 11 adjacent needle 12** to introduce steam.

A hollow chamber 18 having an inlet section **18*a* is positioned immediately above sleeve 11 to receive yarn which passes through sleeve 14. A large number of balls 19*a* and 19*b* are disposed within chamber 18. Chamber 18 is provided with an outlet conduit 21 which is connected to a drain. A screen 21*a* is positioned across the inlet of conduit 21. The apparatus thus far described constitutes a texturing device of the type disclosed in U.S. Pat. No. 3,678,547, the disclosure of which is herein incorporated by reference. In the operation of this apparatus, filaments 20*a* to be textured are inserted through needle 12 into the central passage of plug 14. The steam introduced through conduit 17 flows upwardly through plug 14 into chamber 18. The velocity of the steam is sufficiently high to produce a zone of turbulence in the flared outlet region 14*c* of plug 14. This turbulence imparts crimp to the filaments to produce textured yarn 20*b*. The yarn passes upwardly to form an elongated generally cylindrical wad 20*c* in the center of chamber 18. Wad 20*c* is surrounded and confined by balls 19*a* and 19*b*. Textured yarn 20*d*** is withdrawn from the wad by suitable removal apparatus, such as described in U.S. Pat. No. 3,778,872, for example.

Sleeve 11 can be provided with a jacket 22 which is surrounded by insulating material 23. Jacket 22 is provided with an inlet 24 and an outlet 25 to permit flow of steam and condensate through the jacket from the source to be described. Connected to outlet 25 is a conduit 32 and a steam trap 33.

In accordance with this invention, a stream of saturated steam is introduced through a conduit 26 which has a pressure regulator 27 associated therewith. The incoming steam at a constant pressure is introduced through an inlet port 28 into a condensate separator which can comprise a cylindrical chamber 29. Any condensate which collects in the bottom of separator 29 is removed through an outlet 30 and conveyed through a conduit 31 to inlet 24 of jacket 22. In addition, a portion of the steam introduced into separator 29 also flows through conduit 31.

A steam superheating device 35 is disposed within separator 29. This superheater comprises a spiral finned heating element 36 which is disposed within a cylindrical vessel 37. The heated fins extend substantially to the wall of vessel 37 to vaporize any condensate which may remain. An orifice 38 is formed in the wall of vessel 37 so that steam flows from separator 29 into vessel 37. Vessel 37 is provided with an outlet 39. A conduit 44, which has a flow control orifice 45 therein, extends between outlet 39 and conduit 17 to deliver steam to the yarn texturing device.

Separator 29 and vessel 37 are provided with pressure taps 41 and 42, to which is connected a differential pressure indicator 43. The resulting differential pressure indicated by device 43 is thus representative of the pressure drop across orifice 38, and this in turn is representative of the rate of flow of steam through the superheater. The size of orifice 45 is selected to provide a predetermined pressure drop, which can be of the order of 20 pounds per square inch (138 kPa), for example. This orifice, in combination with pressure regulator 27, thus provides a flow control device. A temperature indicator-controller 46 is connected to conduit 44 near conduit 17 to provide a measurement of the temperature of the steam introduced into device 10. Controller 46 provides an output signal which is applied to heater 35 to adjust the heat supplied by the superheater so as to maintain the temperature of the steam constant. A pressure indicating device 47 is also connected to conduit 44 near conduit 17. Device 47 provides an indication of the pressure at which the steam is delivered to the yarn texturing device. The measured pressure is also applied to a low-pressure switch 48. Pressure switch 48 is adjusted so as to turn off heater 35 in the event that the measured pressure falls below a predetermined value. This prevents the heater from being burned out in the event that there is a failure of steam flow through the system.

In one specific embodiment of this invention, steam is introduced into conduit 17 of the yarn texturing device at a rate of approximately 20 pounds (9.1 kg) per hours. Steam is introduced through port 28 at a pressure of approximately 112 psig. The orifices are sized so that a pressure drop of approximately 2 psi (13.8 kPa) occurs across orifice 38, and a pressure drop of approximately 20 psi (138 kPa) occurs across orifice 45. Thus, the steam introduced into conduit 17 is at a pressure of about 90 psig (621 kPa). The pressure at which the steam is introduced into conduit 17 can be regulated to some extent by the position of needle 12 relative to inlet 14*a* of plug 14. If the measured flow should change, some adjustment can be made by adjusting the position of needle 12. Heater 35, which can be an electrical heater of 500 watts, for example, is regulated by temperature controller 46 so as to maintain the temperature of the steam in conduit 44 at about 365° F. (185° C.).

It is not essential that separator 29 be positioned so as to surround superheater 35. Instead, the separator can be located upstream from the superheater. However, the illustrated arrangement is preferred because it minimizes the possibility of any condensate being present in the steam introduced into conduit 17.

While this invention has been described in conjunction with a presently preferred embodiment, it should be evident that it is not limited thereto.

What is claimed is:

1. Apparatus adapted to texture yarn by the use of steam which is supplied at a predetermined temperature and free of condensate, comprising:

yarn texturing apparatus in which yarn to be textured is contacted with steam so as to impart turbulence to the yarn and texture same, said yarn texturing apparatus being provided with a jacket;

a heater adapted to elevate the temperature of a fluid passed therethrough, said heater having an inlet and an outlet;

a steam condensate separator having an inlet to receive steam and a first outlet through which steam can be removed, said separator also having a second outlet to remove condensate;

means connecting the first outlet of said separator to the inlet of said heater;

first conduit means connected between the outlet of said heater and said yarn texturing apparatus to pass condensate-free steam to said yarn texturing apparatus;

temperature sensing means connected to said first conduit means to measure the temperature of steam therein;

control means responsive to said temperature sensing means to regulate said heater to maintain the temperature of steam in said first conduit means constant; and second conduit means connected between the first outlet of said separator and said jacket to pass steam and condensate from said separator to said jacket.

2. The apparatus of claim 1 wherein said separator comprises a vessel which encloses at least a part of said heater.

3. The apparatus of claim 1, further comprising flow measuring means associated with said means connecting the first outlet of said separator to the inlet of said heater.

4. The apparatus of claim 1, further comprising flow control means associated with said first conduit means.

5. The apparatus of claim 1, further comprising pressure sensing means connected to said first conduit means to measure the pressure of fluid therein, and means responsive to said pressure sensing means to turn off said heater when the measured pressure falls below a predetermined value.

6. The apparatus of claim 1 wherein said separator comprises a vessel which encloses at least a part of said heater, and further comprising flow measuring means associated with said means connecting the first outlet of said separator to the inlet of said heater, and flow control means associated with said first conduit means.

* * * * *